United States Patent [19]

Newman et al.

[11] 4,067,441

[45] Jan. 10, 1978

[54] COIL OF FLEXIBLE MATERIAL WITH INSERTS IN OUTER WALL

[75] Inventors: James W. Newman, Scarsdale; Ronald E. Zajac, Yonkers, both of N.Y.

[73] Assignee: Windings, Inc., Goldens Bridge, N.Y.

[21] Appl. No.: 686,568

[22] Filed: May 14, 1976

[51] Int. Cl.[2] ..... B65H 55/02

[52] U.S. Cl. ..... 206/398; 206/409; 242/163; 242/168; 242/170; 242/172

[58] Field of Search ..... 242/163, 159, 168, 169, 242/170, 171, 172; 206/398, 409

[56] References Cited

U.S. PATENT DOCUMENTS

| | | | |
|---|---|---|---|
| 2,634,923 | 4/1953 | Taylor, Jr. | 242/163 |
| 3,061,238 | 10/1962 | Taylor, Jr. | 242/163 |
| 3,178,130 | 4/1965 | Taylor, Jr. | 242/163 |
| 3,666,200 | 5/1972 | Newman et al. | 242/163 |

*Primary Examiner*—Stanley N. Gilreath

*Attorney, Agent, or Firm*—Watson, Cole, Grindle & Watson

[57] ABSTRACT

In a coil of material wound in a series of figure-8 coils with the crossovers progressing around the package but being interrupted at one point to provide a radial opening into the axial opening of the coil, in order to produce a thick-walled coil the material is first wound in a normal way with varying gains in order to produce a set of dense inner layers, while the outer layers are wound without variation in the gain to produce a honeycomb structure. The honeycomb section is of greater width (axially of the package) than the inner layers. A plurality of pins slidably mounted on a strip are pushed into the outside of the package through the openings in the honeycomb, whereafter the outer layers are compressed axially while retaining the pins within the outer layers. The pins permit payoff of the outer layers without danger of their collapsing and thereby forming kinks or twists within the package.

9 Claims, 4 Drawing Figures

COIL OF FLEXIBLE MATERIAL WITH INSERTS IN OUTER WALL

BACKGROUND OF THE INVENTION

1. Field of the Invention

The invention relates to a coil of flexible material wound in a series of figure-8s with a radial hole into the axial opening for twistless payout through the hole.

2. The Prior Art

Coils of this sort are known for example from Taylor U.S. Pat. No. 2,634,722 and Newman U.S. Pat. No. 3,666,200.

Such coils are satisfactory where the wall thickness of the coil is not too great, particularly not greater than the radius of the mandrel on which the coils are wound. However, in winding thick-walled coils, particularly when these are paid out from a position in which the radial opening is arranged vertically, there is danger that the outer wall layers, when the inner layers have been withdrawn, will fall off downwardly, and will thus cause kinks or snarls which will prevent proper payout. This presents difficulties in producing coils of long length.

SUMMARY OF THE INVENTION

The invention provides a method for producing a coil having means for preventing falloff of the walls of the outer layers during payout, and a coil produced by such a method.

According to the invention, the inner layers of the coil are wound in a normal manner, that is with a different gain from layer to layer, so that a compact structure is obtained. Attempts have been made to continue such a wind outwardly to a considerable wall thickness, and thereafter to insert pins into the side of the coil from the outside, for the purpose of preventing falloff. It has been found however that such pins, even when made of a relatively soft plastic material, may penetrate or deform the material of the coil, even a coil formed of wire. It appears that the forcing of the pins into the side wall therefore damages the coil and prevents proper payout.

According to the present invention, the inner portion of the coil is wound in a normal manner wth a variable gain from layer to layer, so that the cross-overs do not overlie each other and a relatively dense section is produced. On the other hand, after a certain point is reached, the gains are made equal in the different layers so that the cross-over substantially overlie each other from layer to layer. This provides a honeycomb section of low density, which of course is undesirable.

According to the invention, the pins which are to prevent fall-off are mounted slidably on a strip of metal and are pushed into the oustside face of the coil, the openings in the honeycomb permitting the pins to enter without breaking or bending the wound material. Thereafter, the sides of the end portions are compressed inwardly, that is, parallel to the axis of the axial opening in the coil, and the pins slide inwardly in their carrier. The density of the end portions is thus substantially increased, and the space required is thus reduced. At the same time, the pins extend into the walls of the coil from the outside and prevent the material from falling off undesirably during the latter part ot the withdrawal.

DESCRIPTION OF THE PREFERRED EMBODIMENTS

Figure 1:
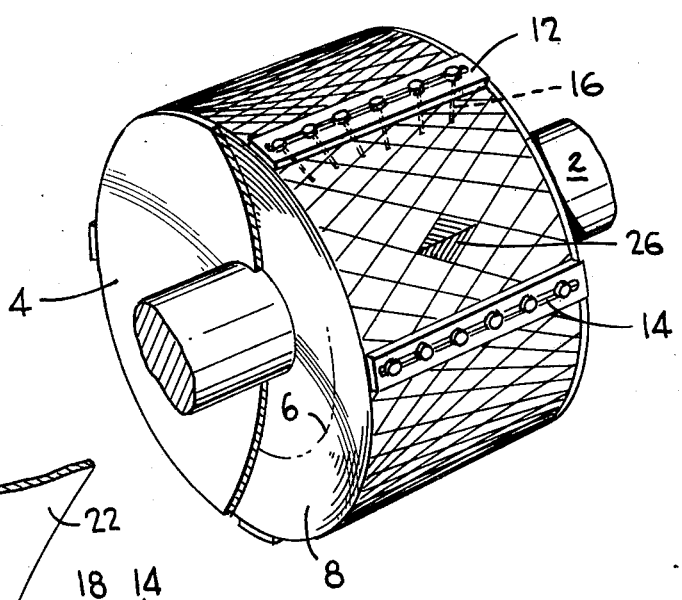
FIG. 1 shows in cross-section the first step of producing a coil according to the invention.

Referring to FIG. 1, the material is wound in the manner described above, and particularly that described in Newman U.S. Pat. No. 3,666,200, on a rotating mandrel 2 having suitable end forms 4. These end forms are outwardly flared. During the first part of the wind, that is for example up to the point indicated by the line 6, the material is wound as described in the above Newman patent, that is, with varying gains from layer to layer, so that a relatively dense section is achieved.

The machine is not set to wind with equal angular gains, and thus forms a honeycomb structure in which the cross-overs in successive layers lie substantially on top of each other, in the portion indicated by the area 8, the width of the guide stroke being sufficient to lay the material across the increasing space between the end forms.

Figure 2:
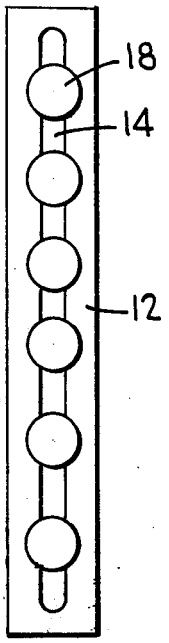
FIG. 2 shows a pin carrier with the pins carried thereby.
Figure 4:
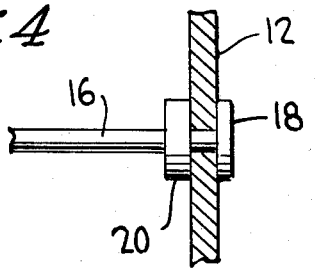
FIG. 4 shows partly in cross-section a section of the arrangement of FIG. 2.

FIG. 2 shows a strip of metal 12 with a slot 14 therein. A plurality of pins 16 having heads 18 are slidably arranged in the slot, and have flanges 20 engaging the other wall of the piece 12 opposite the heads 18. These flanges may fit closely enough to give a frictional grip on the strip 12, so that undesirable sliding of the pins in the slot is prevented. The pins may be made of a relatively soft plastic material.

After the winding is completed, several of the pieces 12, angularly spaced around the periphery, are pushed against the outer periphery of the winding, and the pins enter into the openings in the honeycomb formation.

Figure 3:
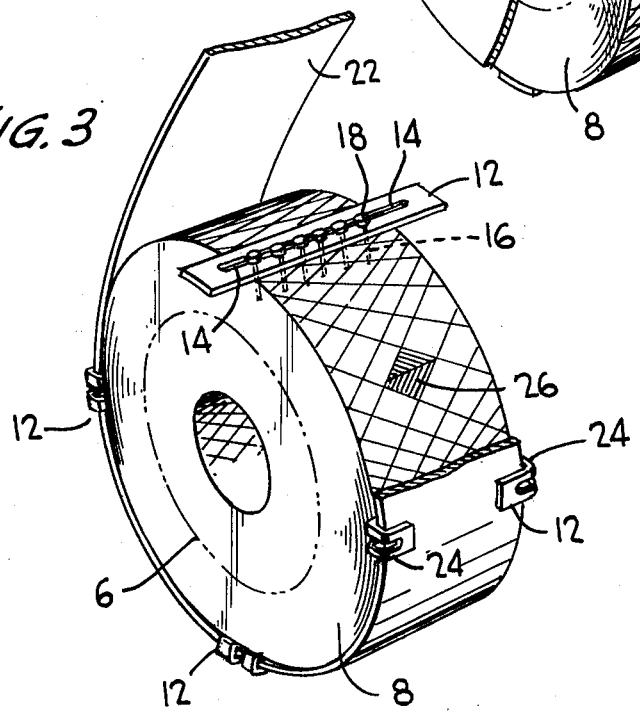
FIG. 3 shows a completed package.

The package is now removed from the mandrel by taking off the end form and collapsing the mandrel if necessary. The package is then compressed in a direction parallel to the axis of the axial opening, as shown for example in FIG. 3. The pins slide down in the slot 14, and approach each other, and the layers are collapsed so that a dense outer section 8 is achieved.

The package may be enclosed in a covering material such as 22. The metal strip 12 may then have the ends bent as at 24 around the outside of the cover 22. This secures the strip in place and ensures holding of the pins firmly in the package.

During winding, in the manner described above, a radial opening 26 is formed from the outside of the package into the axial opening through which the inner end of the material can be led out.

We claim:

1. A method of forming a coil of flexible material comprising a plurality of figure-8s with the cross-overs of the figure-8s progressing around the periphery of the coil and having a radial hole and an axial opening, and with the radial hole extending from the periphery of the coil to the axial opening of the coil, which comprises winding a plurality of layers with the gains varying from layer to layer, thereby producing a relatively dense central section, and winding an outer section of the coil with the gains substantially equal from layer to layer, thereby producing a wider portion having a substantially honeycomb nature, inserting a plurality of pins through the outside face of the coil into the outer section thereof, and compressing the outer section axially to a dimension substantially equal to the dimension of the inner section.

2. In a method as claimed in claim 1, wherein said step of inserting a plurality of pins includes the preliminary step of mounting a plurality of pins on at least one elongated strip and inserting said mounted pins into the outside of the coil while held by the strip, said pins being slidable longitudinally of said at least one strip during said step of compressing.

3. A coil of flexible material wound in a plurality of figure-8s having their cross-overs progressing around the coil in each layer and having a radial opening extending from the outside into an axial opening of the coil, the coil having a wall thickness substantially greater than the radius of said axial opening, and having a plurality of pins spaced from each other extending from the outer surface of the coil into the outer layers thereof, said pins being spaced in a direction substantially parallel to the axis of said axial opening.

4. A coil of flexibel material as in claim 3 further comprising at least one elongated strip including an aperture for slidably mounting said pins.

5. A coil of flexible material as in claim 4 further comprising a covering material covering said coil of flexible material with the end portions of said at least one elongated strip being folded to engage said covering material.

6. A coil of flexible material as in claim 4 further comprising a plurality of said elongated strips and groups of the said plurality of pins are spaced within each respective elongated strip and said plurality of strips and associated groups of pins are inserted into said coil at spaced positions around the periphery thereof.

7. A method as in claim 2 wherein groups of said mounted pins are associated with a respective elongated strip and further comprising the step of mounting a plurality of said elongated strips in spaced relationship about the periphery of said coil.

8. A method as in claim 7 further comprising the step of enclosing said coil in a covering material and bending the end portions of said elongated strips to engage said covering material.

9. A method as in claim 8 wherein said elongated strips have a length substantially equal to the width of said coil and the end portions of said strips are extended beyond the side walls of said coil by said step of compressing.

* * * * *